United States Patent [19]

Osawa et al.

[11] Patent Number: 4,729,295

[45] Date of Patent: Mar. 8, 1988

[54] METHOD OF OPERATING AN AIR-SUPPLIED TYPE COATING BOOTH

[75] Inventors: Michiaki Osawa, Nagoya; Hidetoshi Omori, Toyota; Hidemasa Inoue; Yoshihiro Shibata, both of Seto; Hideyuki Takata, Nagoya; Yasuo Tokushima, Toyota; Shunichi Akiyama, Toyota; Masayuki Kojima, Toyota; Zyouzi Itou, Toyota, all of Japan

[73] Assignees: Trinity Industrial Corporation, Tokyo; Toyota Jidosha Kabushiki Kaisha, Toyota, both of Japan

[21] Appl. No.: 947,383

[22] Filed: Dec. 29, 1986

[30] Foreign Application Priority Data

Dec. 27, 1985 [JP] Japan ..... 60-293216

[51] Int. Cl.[4] ..... B05B 15/12

[52] U.S. Cl. ..... 98/115.2; 55/DIG. 46

[58] Field of Search ..... 98/115.1, 115.2, 115.3; 55/210, DIG. 46; 417/43; 118/326

[56] References Cited

U.S. PATENT DOCUMENTS

| | | | |
|---|---|---|---|
| 3,518,814 | 7/1970 | Maynard | 417/43 X |
| 4,261,256 | 4/1981 | Joret | 98/115.2 |
| 4,557,184 | 12/1985 | Orii et al. | 98/115.3 |
| 4,653,387 | 3/1987 | Osawa et al. | 98/115.2 |

FOREIGN PATENT DOCUMENTS

| | | | |
|---|---|---|---|
| 26359 | 4/1981 | European Pat. Off. | 98/115.2 |

*Primary Examiner*—Harold Joyce

*Attorney, Agent, or Firm*—Cushman, Darby & Cushman

[57] ABSTRACT

A method of operating an air-supplied type coating booth adapted to enforce conditioned air by an air supply blower through a filter downwardly to the inside of a tunnel-shaped coating booth at a predetermined flow velocity and then drawn to discharge together with coating mists, etc. to the beneath of the floor comprises the step of detecting the flow velocity of conditioned air flowing through the filter to the inside of continuously, applying primary and secondary averaging processings for the detected signals containing variations fluctuating at relatively shorter and longer periods respectively, comparing the value obtained from the signals applied with the secondary averaging processing with a predetermined flow velocity value and variably controlling the flow rate of the air supplied from the air supply blower depending on the deviation and thereby maintaining the flow velocity of the conditioned air flowing to the inside of the coating booth always constant. Reduction of the flow velocity supplied to the inside of the air-supplied type coating booth due to the filter clogging can be compensated exactly with no effects of external disturbances.

10 Claims, 5 Drawing Figures

METHOD OF OPERATING AN AIR-SUPPLIED TYPE COATING BOOTH

BACKGROUND OF THE INVENTION

1. Field of the Invention

This invention concerns a method of operating an air-supplied type coating booth and, more specifically, it relates to a method of operating an air-supplied type coating booth in which conditioned air supplied from a supply blower to a plenum chamber is enforced through a filter to the inside of a tunnel-shaped coating booth at a predetermined flow velocity and the air in the coating booth is drawn to exhaust together with coating mists, evaporated organic solvents and the likes by an exhaust blower to the beneath of a booth floor.

2. Description of the Prior Art

In a relatively large-scaled air-supplied type coating booth for coating articles, e.g., car bodies conveyed successively on a conveyor, conditioned air supplied from a supply blower to a plenum chamber is enforced through a filter to the inside of the coating booth, caused to flow downwardly at a predetermined flow velocity in the coating booth and then drawn to exhaust together with coating mists, evaporated organic solvents and the likes to the beneath of a booth floor. This downwarded air flow can prevent the coating mists, dusts or the likes that would otherwise give undesired effects on coated films from scattering and drifting upwardly in the coating booth, thereby maintaining a desirable coating quality, as well as keeping the health of operators who make preparation for the coating work or conduct manual spray coating in the coating booth.

In this case, the flow velocity of the conditioned air enforced through the filter to the inside of the coating booth is usually set to about 0.2–0.5 m/sec.

However, since the filter used for enforcing the conditioned air supplied to the plenum chamber to the inside of the coating booth is often clogged with the elapse of time by dusts or the likes and the flow velocity of the conditioned air enforced through the filter to the inside of the coating booth is gradually lowered.

If the flow velocity of the conditioned air enforced into the coating booth is reduced with the elapse of time, coating mists, evaporated organic solvents, dusts or the likes resulted upon spray coating drift at the inside of the coating booth to degrade the coating quality and, at the same time, worsen the working circumstances.

Further, the balance between the flow rate of the air supplied from the supply blower and that of the exhaust discharged from the exhaust blower is lost thus leading to the intrusion of external air through the inlet and the exit of the coating booth to degrade the coating quality.

Such disadvantages may be overcome by the frequent exchange of the filter but the replacing work is extremely troublesome.

In view of the above, it has been attempted in recent years to measure the flow velocity of air supplied into the coating booth and control the number of rotation of the air supply blower depending on the measured value. However, since the flow velocity of air at the lower surface of the filter is as low as from 0.2 to 0.5 m/sec and there are also involved various factors of external disturbances resulted from the air conditioning device or the like, no satisfactory control can be attained yet.

That is, the flow rate of the supplied air may sometime be increased abruptly by the intrusion of a sudden wind through the gallery (suction port) of the air conditioning device for supplying conditioned air to the inside of the coating booth. Further, the air flow rate also varies due to the change in the air density depending on the temperature change in the preheating heater disposed in the air conditioning device or on the change in the pressure loss due to the increase or decrease in the flow rate of water jetted from a humidifying shower disposed in the air conditioning device. Furthermore, the stream of the conditioned air is disturbed upon contact with the flow velocity sensor used for measuring the flow velocity, falling to obtain exact detection for the flow velocity of the conditioned air.

In view of the above, the present inventors, et. al. have made various studies and experiments on the measurement of the flow velocity of air supplied to the coating booth and on the control of the air supply blower and, as a result, found that signals obtained from the continuous measurement for the flow velocity of air supplied by the flow velocity sensors often contain primary variations fluctuating at relatively short period, for example, about from 1 to 4 sec, which may be attributable to external disturbances such as the characteristics of the flow velocity sensor per sc and secondary variations external disturbances fluctuating at relatively longer period, for example, about from 10 to 30 sec, which may be attributable to the external disturbances such as atmospheric air drawn to the air conditioning device or the change in the operation states of warming and humidifying device, as well as that exact control is possible by controlling the air supply blower using the signals after removed with the primary and secondary variations caused by such external disturbances.

OBJECT OF THE INVENTION

Accordingly it is an object of this invention to provide a method of operating an air-supplied type coating booth capable of detecting the flow velocity of conditioned air enforced from a plenum chamber through a filter to the inside of a coating booth, reliably measuring the reduction in the flow velocity of the conditioned air caused by the clogging in the filter with no errors due to external disturbances, and variably controlling the flow rate of air supplied from the supply blower thereby maintaining the flow velocity of the conditioned air flowing downwardly in the coating booth always constant irrespective of the clogging in the filter.

SUMMARY OF THE INVENTION

The foregoing object of this invention can be attained by a method of operating an air-supplied type coating booth in which conditioned air supplied from an air supply blower to a plenum chamber is enforced through a filter to the inside of a tunnel-shaped coating booth at a predetermined flow velocity, caused to flow downwardly in the coating booth at a predetermined flow velocity and then drawn to discharge together with coating mists, evaporated organic solvents and the likes to the beneath of the floor, wherein the method comprises:

a step of detecting the flow velocity of the conditioned air flowing from the plenum chamber through a filter to the inside of the coating booth continuously by a flow velocity sensor;

a step of sampling the signals for the detected flow velocity at a predetermined sampling period and applying the primary averaging processing for the variations fluctuating at relatively shorter period caused by the external disturbances such as characteristics of the sensor;

a step of sampling the signals after applied with the primary averaging processing at a predetermined sampling period and applying the secondary averaging processing for the variations fluctuating at relatively longer period caused by external disturbances such as gradual change of states in the air conditioning device and the like;

a step of comparing the value obtained from the signals after applied with the secondary averaging processing with a predetermined flow velocity value;

a step of variable controlling the flow rate supplied from the air supply blower depending on the deviation therebetween, and thereby maintaining the flow velocity of the conditioned air flowing to the inside of the coating booth always constant.

According to the method of this invention, if the flow velocity of the conditioned air flowing to the inside of the coating booth is lowered due to the clogging in the filter, the flow velocity is detected and compared with a predetermined flow velocity (for example, 0.4 m/sec), the flow rate of the air supplied from the supply blower is increased by a required flow rate depending on the deviation, and the the flow velocity of the conditioned air flowing downwardly in the coating booth can be prevented from lowering.

Further, detected signals from the flow velocity sensor for detecting the flow velocity of the conditioned air flowing into the coating booth usually include primary variations caused by external disturbances fluctuating at relatively shorter period e.g., about from 1 to 4 seconds attributable to the characteristics of the flow velocity sensor per se or by the disturbances in the stream of the conditioned air flowing in contact with the sensors, and secondary variations caused by external disturbances fluctuating at relatively longer period, e.g., about from 10 to 30 seconds attributable to the effect of external air drawn to the air conditioner or the change in the operation states of the warming device, humidifying device or the like in the air conditioner, and these variations would make the control for the flow rate of supplied air difficult and inaccurate.

In the method according to this invention, however, since the signal for detected flow velocity from the flow velocity sensor are sampled at a predetermined sampling period and applied with a primary averaging processing thereby eliminating the effect due to the primary variations and, further, the signals after applied with the primary averaging processing are further sampled at another predetermined sampling period and applied with the secondary averaging processing thereby eliminating the effect due to the secondary variations, the change in the flow velocity due to the clogging in the filter can exactly be measured to thereby maintain the flow velocity of the conditioned air flowing downwardly in the coating booth at a constant velocity while being free from the effects of variations in the signals caused by the external disturbances.

BRIEF DESCRIPTION OF THE ACCOMPANYING DRAWINGS

These and other objects, as well as the features of this invention will now be described more specifically by way of a preferred embodiment thereof while referring to the accompanying drawings, wherein FIG. 1 is a schematic view illustrating an example of an air supplied type coating booth applied with the method according to this invention;

DESCRIPTION OF PREFERRED EMBODIMENT

This invention will now be described more specifically by way of its preferred embodiments illustrated in the accompanying drawings.

Figure 1:
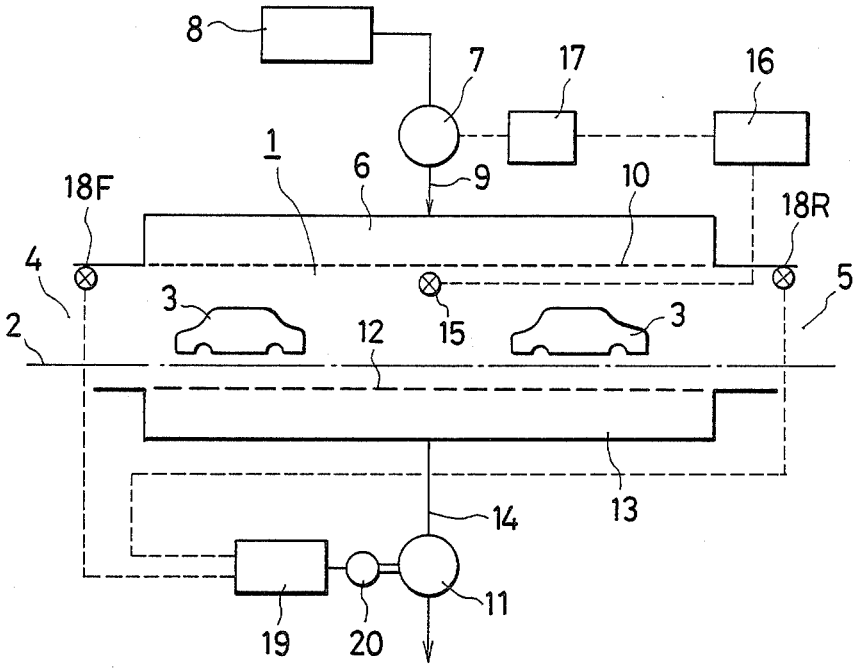

FIG. 1 is a schematic view illustrating an example of an air-supplied type coating booth applied with the method according to this invention.

In the drawing, tunnel-shaped coating booth 1 is adapted for conducting spray coating to car bodies 3, 3, —conveyed successively on floor conveyor 2 or the like. Inlet 4 and exit 5 opened at both ends of the coating booth 1 are in communication with the pre-treatment device at the preceeding stage and the drying furnace at the subsequent stage (both not illustrated) to the booth 1 respectively.

In the coating booth 1, plenum chamber 6 is disposed along the ceiling thereof, and conditioned air supplied from air conditioner 8 by air supply blower 7 through air supply duct 9 to the inside of the plenum chamber 6 is enforced through filter 10 to the inside of the coating booth 1.

The conditioned air enforced into the coating booth 1 is caused to flow downwardly in the booth 1 at a predetermined flow velocity (0.2–0.5 m/sec), drawn together with coating mists, evaporated organic solvents and the likes resulted in the coating booth 1 into mist processing chamber 13 below floor surface 12 by exhaust blower 11, removed with the coating mists by gas-liquid contact in the mist processing chamber 13, and then exhausted externally through exhaust duct 14.

Flow velocity sensor 15 is disposed below the plenum chamber 6 for detecting the flow velocity of the conditioned air flowing from the plenum chamber 6 through the filter 10 to the inside of the coating booth 1. The flow velocity sensor used herein is a heat sensitive type flow velocity sensor which is adapted to output the change in the voltage or current depending on the change in the electrical resistance of a heated wire exposed to an air stream as the flow velocity detection signals to control device 16.

The control device 16 determines the flow velocity of the conditioned air flowing to the inside of the coating booth 1 by processing the signals for the detected flow velocity continuously inputted thereto, compares the measured flow velocity with a predetermined flow velocity (for example, 0.4 m/sec), outputs a control signal depending on the deviation therebetween for varying the number of rotation or the angle of blade of the supply blower 7 to operation section 17 to thereby control the flow rate of the air from the supply blower 7 and controls the conditioned air enforced to the inside of the coating booth 1 so as to flow downwardly at a predetermined constant flow velocity.

Flow velocity sensors 18F and 18R are disposed at the inlet 4 and the exit 5 of the coating booth 1 respectively for detecting the flow velocity of the air flowing into and out of the inlet 4 and the exit 5. Control device 19 is disposed for conducting inverter-control of the number of rotation of motor 20 for the exhaustion blower 11. It is adapted to control the exhaust flow rate by variably controlling the number of rotation of the exhaust blower 11 depending on the flow rate of air flowing into and out of the coating booth 1 calculated based on the flow velocity detected by the flow velocity sensors 18F and 18R thereby maintaining the balance between the exhaust flow rate and the air flow rate to suppress the air from flowing into and out of the inlet 4 and the exit 5.

Figure 2:
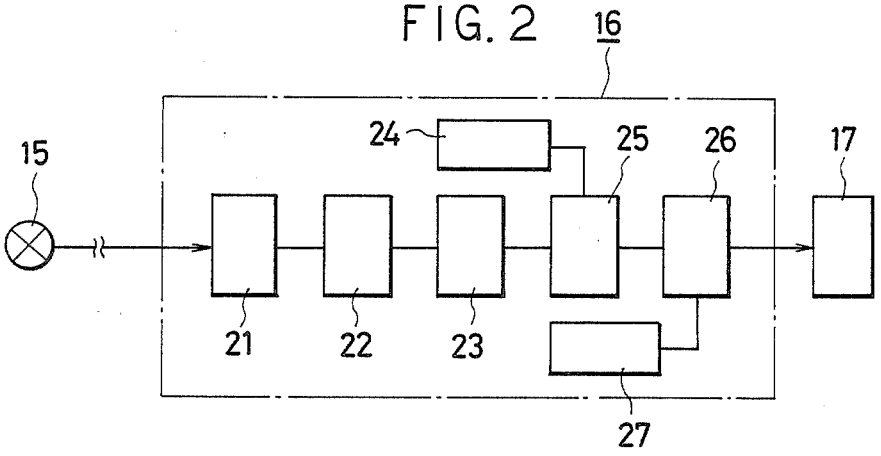
FIG. 2 is a block diagram illustrating one embodiment of the control device used therefor.

FIG. 2 is a block diagram illustrating the constitution of the control device 16. The control device 16 comprises sampler 21 for continouly sampling the signals for detected flow velocity outputted from the flow velocity sensor 15 at a predetermined sampling period (for example, 0.2 sec), digital filter 22 working on a transmission function with a first order lag, moving averaging section 23 for sampling the output signals from the digital filter 22 at a predetermined sampling period (for example, 4 sec) to apply moving averaging processing to determine the flow velocity at that time point, comparator 25 for comparing the flow velocity determined by the processing section 23 with a flow velocity previously set by setter 24 and adjuster 26 for executing a predetermined PID calculation based on the output from the comparator 25. The adjuster 26 outputs an actuation signal for controlling the flow rate of air to the operation section 17 that variably controls the number of rotation or angle of blade of the supply blower 7.

Figure 3:
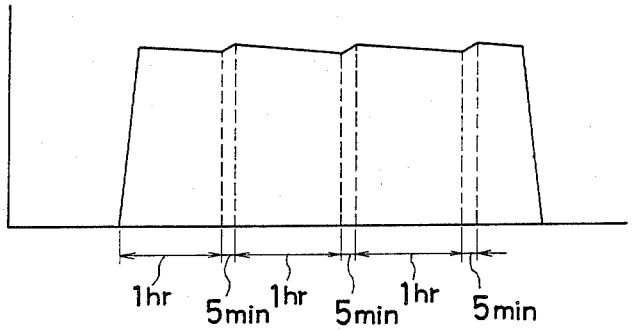
FIG. 3 is an explanatory view illustrating the change in the flow velocity in the coating booth.

Intermittent sequencer 27 is disposed for instructing the execution of the mathematical processing in the adjuster 26 on every predetermined time. For instance, it turns OFF the adjuster 26 for the initial one hour from the start of the booth operation to fix the number of rotation or the angle of blade of the supply blower thereby supplying the conditioned air at a constant flow rate to the plenum chamber 6. Then it turns ON the adjuster 26 for about 5 minutes on every another one hour in which the flow velocity changes more or less in the coating booth 1 along with the increase of clogging in the filter 10, to execute the control for the air flow rate thereby control the number of rotation or the angle of blade of the feed blower 7 so as to maintain the flow velocity in the coating booth 1 to a predetermined level as shown in FIG. 3.

Figure 4:
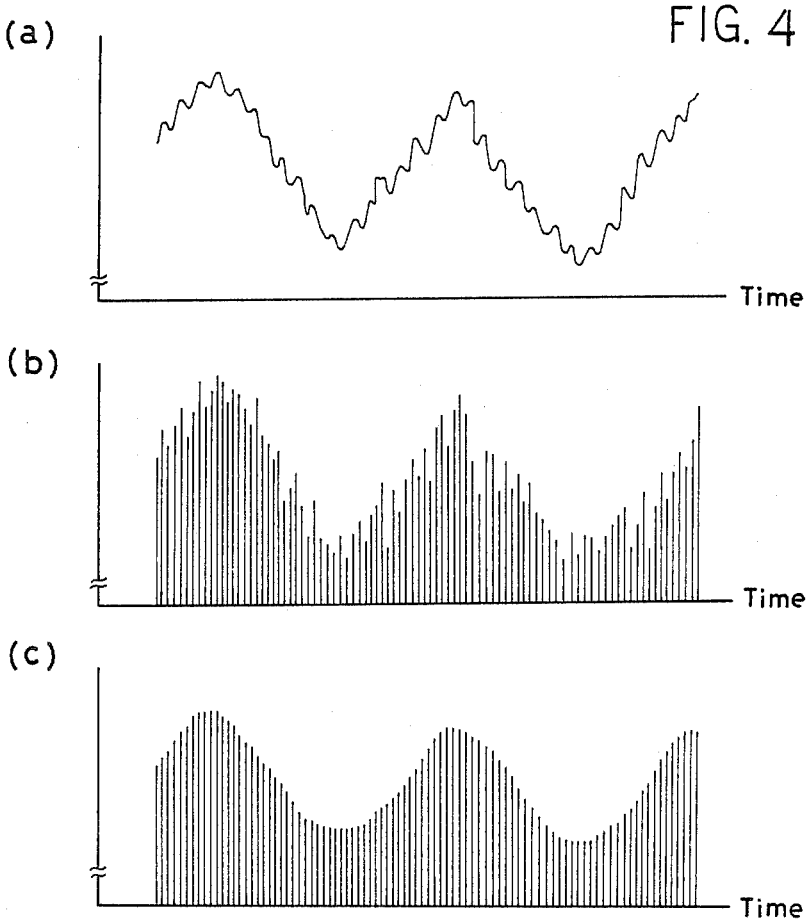
FIGS. 4 and 5 are explanatory views for the examples of signal waveforms at each of the points in the control device.
Figure 5:
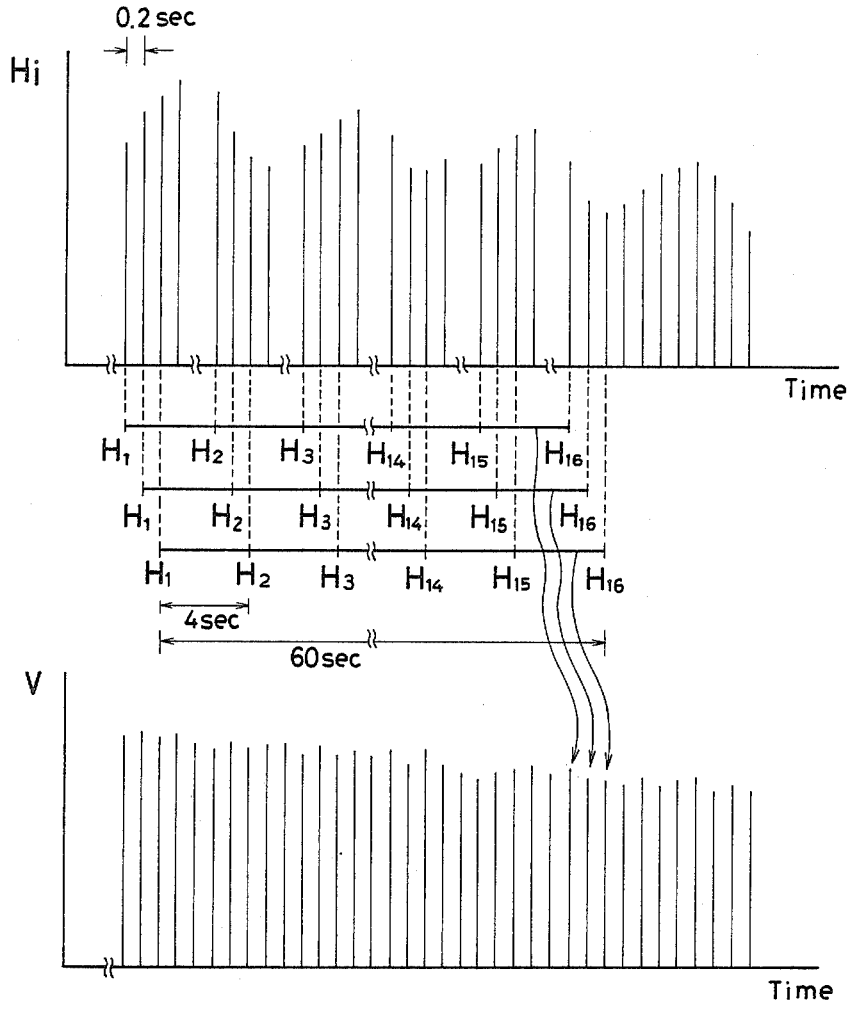

FIGS. 4 and 5 are explanatory views, respectively, illustrating the signal waveforms in each of the points of the control device 16.

In the case where the signals for detected flow velocity outputted from the flow velocity sensor 15 include the primary variations due to external disturbances fluctuating at relatively shorter period of about 20 cycle/min and the secondary variations due to external disturbances fluctuating at relatively longer period of about 4 cycle/min as shown, for example, in FIG. 4(*a*), the detected signals are at first sampled by the sampler 21 at a 0.2 sec period into digital signals represented by the pulse train as shown in FIG. 4(*b*).

Then, when the digital signals are inputted to the digital filter 22, since the digital filter 22 works on a transmission function with the first order lag: $1/(1+Ts)$, the signals are waveform-shaped into signals as shown in FIG. 4(*c*), in which the primary variations due to external disturbances fluctuating at 20 cycle/min are removed and are then inputted to the moving averaging processing section 23 and subjected to moving averaging processing.

The moving averaging processing means such a method of averaging the values for n shots of input signals sampled at a period $T/(n-1)$ within a predetermined moving average time T and using the mean value thus obtained as the flow velocity at the time point. This averaging processing is carried out for eliminating the effects resulted when the air stream is fluctuated or disturbed at relatively longer period of time in the coating booth 1.

Assuming, for example, the moving average time T as 60 sec and the sampling period in the moving average processing section 23 as 4 sec, the number of the sampled signals is: $n=60/4+1=16$. As shown in FIG. 5, the flow velocity can be determined as the mean value for 16 input signals sampled at 4 sec interval.

That is, assuming the input signals sampled in the moving average processing section 23 as Hi, the flow velocity V is calculated as :

$$V=\left(\sum_{i=1}^{16} Hi\right)/16$$

Since signals are inputted at 0.2 sec interval to the moving average processing section 23, the moving average processing is applied on every new inputs and the processed values are outputted as shown in FIG. 5.

In this way, since the mean value is determined within a sufficiently longer moving averaging time (for instance, 60 sec) as compared with the sampling period (4 sec) in the moving average processing, variations due to the temporary fluctuations or disturbances of the air stream in the coating booth 1, if any, can be averaged into signals removed with such secondary variations, and unnecessary and undesired control for the of the air flow rate due to the effect of such variations can be suppressed (refer to the lower chart in FIG. 5).

Then, the flow velocity calculated in the moving average processing section 23 and a predetermined flow velocity (for example, 0.4 m/sec) previously set to the setter 24 are compared with each other in the comparator 25, and the deviation therebetween is inputted to the adjuster 26 to perform PID calculation.

In the PID calculation, an operation signal is obtained by using a controller for three operations, i.e., proportional operation P, integrating operation I and differentiation operation D. Since the differentiation operation is not generally required in the flow rate control, the output (operation signal) M from the adjustes 26 in the PID calculation for the digital signals as in the present embodiment is represented as:

$$M=MI+dM=MI+K\,(E-EI+(t/Ti)\,E)$$

where

MI: output at the preceeding time,
E: input (deviation),
EI: preceeding input,
K: proportional gain,
t: period for input signal, and
Ti: integration time.

Then, the output M thus determined is sent as the operation signal to the operational section 17 and the number of rotation or the angle of blade of the supply blower 7 is controlled by the operation section 17 to control the flow rate of the supplied air such that the flow velocity in the coating booth 1 may be maintained to a predetermined level.

The method of operating the embodiment of the air-supplied type coating booth having thus been constituted and applied with this invention well be described next.

At first, the air supply blower 7 is driven at a predetermined number of rotation or angel of blade while setting the flow velocity of the conditioned air supplied to the inside of the coating booth 1 by the sctter 24 (for example to 0,4 m/sec), and the exhaust blower 11 is driven at a predetermined number of rotation such that the flow rate of air supplied from the supply blower 7 and the flow rate of exhaust discharged from the exhaust blower 11 are made balanced.

In this case, if the balance between the flow rate of exhaust and the flow rate of supplied air is lost depending on the change in the quantity of car bodies 3 being conveyed in the coating booth 1, the velocities of air flowing into and out of the booth through the inlet 4 and the exit 5 are detected by the flow velocity sensors 18F and 18R and the number of rotation of the exhaust blower 11 is variably controlled by the control device 19 to thereby recover the balance between the flow rate of the supplied air and the flow rate of the exhaust.

Although the supply blower 7 is driven at a predetermined number of rotation or angle of blade so that the flow velocity of the conditioned air is made constant, clogging is resulted in the filter 10 with the elapse of time as the coating booth is operated for a long period of time and the flow velocity of the conditioned air flowing to the inside of the coating booth 1 through the filter 10 is gradually decreased (refer to FIG. 3).

In view of the above, the intermittent sequencer 27 is actuated on every elapse of predetermined time (for example, one hour) when the flow velocity of the conditioned air flowing to the inside of the coating booth 1 changes somewhat, to thereby turn ON the adjuster 26. Then, the PID calculation for controlling the flow rate of air supplied from the supply blower 7 is intermittently started.

At first, the flow velocity of the conditioned air flowing through the filter 10 to the inside of the coating booth 1 is continuously detected by the flow velocity sensor 15 at a sampling period, for example, 0.2 sec. Then, the primary averaging processing and the moving averaging processing are carried out in the digital filter 22 and the moving average processing section 23 respectively based on the detected flow velocity data to measure the flow velocity in the coating booth, which is lowered due to the clogging in the filter 10, and the measured flow velocity is compared with the setting flow velocity (0.4 m/sec).

Then, the PID calculation is effected in the adjuster 26 and a control signal outputted to the operational section 17 for controlling the number of rotation or the angle of blade of the supply blower 7 so as to increase the flow rate of air supplied to the plenum chamber 6 depending on the deviation and the number of rotation or the angle of blade of the air feed blower 7 is adjusted by the operation section 17. Then, when the flow velocity of the conditioned air supplied to the inside of the coating booth 1 and the setting flow velocity agree with each other after the elapse of a required time (about 5 minutes), the adjuster 26 is turned OFF by the intermittent sequencer 27, by which the number of rotation or the angle of blade of the supply blower 7 is fixed to the optimum number of rotation or the angle of blade at that time point and the supply blower is operated continuously for further next one hour.

In this way, by detecting the flow velocity of the conditioned air flowing to the inside of the coating booth 1 on every predetermined time, comparing the detected velocity with the predetermined flow velocity (for example, 0.4 m/sec) and increasing the flow rate from the supply blower 7 by a required flow rate depending on the deviation reduction in the flow velocity of the conditioned air due to the clogging in the filter 10 can be prevented. Accordingly, the coating circumstance can always be maintained favorably with no trouble of frequently replacing the filter 10 as usual and degration in the coating quality or worsening in the working circumstance due to the upward scattering of coating mists, dusts or the likes can surely be prevented.

Further, when the signals for detected flow velocity from the flow velocity sensor 15 are sampled at a sampling period of 0.2 sec and the primary delay averaging is applied as the primary averaging proceesing, it is possible to completely remove the primary variations fluctuating at about 20 cycle/min contained in the detection signals from the flow velocity sensor if they are resulted due to the disturbance of the air stream when the air flowing from the plenum chamber 6 through the filter 10 to the coating booth is brought into contact with the flow velocity sensor 15.

Furthermore, when the signals after applied with the first averaging processing are sampled at a sampling period of 4 sec and applied with the moving averaging processing as the secondary averaging processing, it is possible to completely remove the secondary variations fluctuating at about 4 cycle/min contained in the detection signals from the flow velocity sensor 15 due to the change in the operation states of the air conditioning device or the like, as well as other fluctuations or disturbances of air stream resulted temporarily in the coating booth 1.

Thus, the flow velocity of the conditioned air flowing down to the coating booth 1 can always be maintained constant without undergoing the effects of the primary and secondary variations caused by external disturbances while exactly detecting only the change in the flow velocity that are attributable to the degree of clogging in the filter 10.

Furthermore, when the control for the flow rate of the supplied is conducted not continuously but intermittently on every predetermined of time by using the intermittent sequencer 27, the interference to the exhaust flow rate can be minimized thereby enabling more stable control.

Although the explanations have been made in the foregoing embodiment to the case of applying PID calculation as the control means in the adjuster 26, this invention is not restricted only thereto but any optional control means can be adopted.

Further, although the explanations have been made for the embodiment in which the averaging processing with the first order lag is applied as the primary averaging processing in the embodiment, it can be substituted with the moving averaging processing. It is preferred in this modified case to set the moving average processing time from 2 to 30 sec in order to completely eliminate the effects of the primary variations (from 2 to 4 sec).

As has been described above by the method according to this invention, the flow velocity of the conditioned air flowing to the inside of the coating booth can be maintained constant by exactly detecting the change in the flow velocity due to the clogging in the filter with no effects from external disturbances, the control for which would rather cause undesirable results for the balance between the flow rate of air from the supply blower and that of exhaust from the exhaust blower.

What is claimed is:

1. A method of operating an air-supplied type coating booth in which conditioned air supplied from an air supply blower to a plenum chamber is enforced through a filter to the inside of a tunnel-shaped coating booth at a predetermined flow velocity, caused to flow downwardly in the coating booth at a predetermined flow velocity and then drawn to discharge together with coating mists, evaporated organic solvents and the likes to the beneath of the floor, wherein said method comprises:

a step of detecting the flow velocity of the conditioned air flowing from said plenum chamber through said filter to the inside of said coating booth continuously by a flow velocity sensor;

a step of sampling the signals for the detected flow velocity at a predetermined sampling period and applying the primary averaging processing for the variations fluctuating at relatively shorter period caused by the external disturbances such as characteristics of the sensor;

a step of sampling the signals after applied with said primary averaging processing at a predetermined sampling period and applying the secondary averaging processing for the variations fluctuating at relatively longer period caused by external disturbances such as gradual change of states in the air conditioning device and the like;

a step of comparing the value obtained from said signals after applied with said secondary averaging processing with a predetermined flow velocity value;

a step of variably controlling flow rate supplied from said air supply blower depending on the deviation therebetween, and thereby maintaining the flow velocity of said conditioned air flowing to the inside of said coating booth always constant.

2. A method of operating the air-supplied type coating booth as defined in claim 1, wherein the sampling period for the primary averaging processing is less than 2 seconds.

3. A method of operating the air-supplied type coating booth as defined in claim 1, wherein the sampling period for the secondary averaging processing is less than 15 seconds.

4. A method of operating the air-supplied type coating booth as defined in any one of claims 1 to 3, wherein the primary averaging processing is applied by a digital filter working on a transmission function with first order lag.

5. A method of operating the air-supplied type coating booth as defined in any one of claims 1 to 3, wherein the primary averaging processing is applied by a moving averaging processing having a moving averaging time from 2 to 30 seconds.

6. A method of operating the air-supplied type coating booth as defined in any one of claims 1 to 3, wherein the secondary averaging processing is applied by a moving averaging processing having a moving averaging time from 10 to 180 seconds.

7. A method of operating the air-supplied type coating booth as defined in claim 4, wherein the secondary averaging processing is applied by a moving averaging processing having a moving averaging time from 10 to 180 seconds.

8. A method of operating the air-supplied type coating booth as defined in claim 5, wherein the secondary averaging processing is applied by a moving averaging processing having a moving averaging time from 10 to 180 seconds.

9. A method of operating an air-supplied type operating coating booth as defined in claim 5 or 6, wherein signal obtained by the moving averaging processing is defined as an averaged value for the value of n shots of input signals sampled at a period T/(n−1) within the moving averaging time T represented by the flowing equation;

$$V = \left( \sum_{i=1}^{n} Hi \right) / n$$

where

V: signal obtained by applying moving average processing

Hi: sampled input signal.

10. A method of operating an air-supplied type operating coating booth as defined in claim 6, wherein signal obtained by the moving averaging processing is defined as an averaged value for the value of n shots of input signals sampled at a period T/(n−1) within the moving averaging time T represented by the following equation;

$$V = \left( \sum_{i=1}^{n} Hi \right) / n$$

where

V: signal obtained by applying moving average processing

Hi: sampled input signal.

* * * * *